US007707792B2

(12) United States Patent
Steele et al.

(10) Patent No.: US 7,707,792 B2
(45) Date of Patent: May 4, 2010

(54) FLOORING SYSTEM WITH GROUT LINE

(75) Inventors: Daniel P. Steele, Troy, TX (US); Curt N. Thompson, Alamo, CA (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

(21) Appl. No.: 12/183,382

(22) Filed: Jul. 31, 2008

(65) Prior Publication Data

US 2009/0038254 A1 Feb. 12, 2009

Related U.S. Application Data

(60) Provisional application No. 60/935,303, filed on Aug. 6, 2007.

(51) Int. Cl.
*E04B 2/00* (2006.01)

(52) U.S. Cl. ..... 52/588.1; 52/582.1; 52/396.04; 52/392

(58) Field of Classification Search ..... 52/582.1, 52/309.9, 392, 396.04, 588.1
See application file for complete search history.

(56) References Cited

U.S. PATENT DOCUMENTS

| | | | | |
|---|---|---|---|---|
| 1,986,739 | A * | 1/1935 | Mitte | 52/591.4 |
| 2,027,292 | A * | 1/1936 | Rockwell | 52/396.1 |
| 3,385,182 | A | 5/1968 | Harvey | |
| 4,644,720 | A * | 2/1987 | Schneider | 52/392 |
| 5,277,011 | A * | 1/1994 | Serrano Martin | 52/588.1 |
| 5,448,865 | A * | 9/1995 | Palmersten | 52/309.9 |
| 5,502,939 | A * | 4/1996 | Zadok et al. | 52/309.9 |
| 5,806,270 | A | 9/1998 | Solano et al. | |
| 6,314,701 | B1 * | 11/2001 | Meyerson | 52/588.1 |
| 6,363,677 | B1 * | 4/2002 | Chen et al. | 52/586.1 |
| 6,490,838 | B2 * | 12/2002 | Summerford | 52/650.3 |
| 6,497,079 | B1 | 12/2002 | Pletzer et al. | |
| 6,691,480 | B2 * | 2/2004 | Garcia | 52/313 |
| 6,694,689 | B1 | 2/2004 | Scott et al. | |
| 6,802,159 | B1 | 10/2004 | Kotler | |
| 6,862,855 | B1 | 3/2005 | Milum et al. | |
| 7,197,855 | B2 | 4/2007 | Della Pepa | |
| 7,243,469 | B2 * | 7/2007 | Miller et al. | 52/311.1 |
| 2002/0071930 | A1 | 6/2002 | Oakey et al. | |
| 2006/0032169 | A1 | 2/2006 | Mei | |

FOREIGN PATENT DOCUMENTS

| | | |
|---|---|---|
| EP | 1146182 | 10/2001 |
| WO | WO98/46843 | 10/1998 |
| WO | WO01/66876 | 9/2001 |
| WO | WO03/087497 | 10/2003 |
| WO | WO2007/080449 | 7/2007 |

* cited by examiner

*Primary Examiner*—Basil Katcheves
(74) *Attorney, Agent, or Firm*—Welsh & Flaxman LLC

(57) ABSTRACT

A flooring panel includes a decorative upper surface and a lower surface. The flooring panel further includes a plurality of edges extending between the decorative upper surface and the lower surface. The plurality of edges are shaped and dimensioned for selective coupling with adjacent flooring panels, wherein each of the plurality of edges includes an edge profile having at least a male coupling member or a female coupling member. The flooring panel also includes at least one notched transition section that extends between one of the plurality of edges of the flooring panel and the decorative upper surface of the flooring panel. When adjacent flooring panels are brought together, the at least one notched transition section of the adjacent flooring panels defines a grout receiving recess into which a material may be poured for creation of the a grout line between the adjacent flooring panels.

10 Claims, 4 Drawing Sheets

FLOORING SYSTEM WITH GROUT LINE

CROSS REFERENCE TO RELATED APPLICATION

This application claims the benefit of U.S. Provisional Patent Application Ser. No. 60/935,303, entitled "FLOORING SYSTEM WITH GROUT LINE", filed Aug. 6, 2007.

BACKGROUND OF THE INVENTION

1. Field of the Invention

The invention relates to laminate flooring products. More particularly, the invention relates to laminate flooring panels including an edge profile providing for the application of a grout line replicating traditional tile flooring.

2. Description of the Related Art

Numerous attempts have been made to replicate conventional ceramic tile and grout flooring surfaces with decorative laminate flooring products. However, none of these prior products have been able to fully replicate the look and feel of traditional ceramic tile and grout flooring surfaces.

As such, a need exists for a decorative laminate flooring system which replicates the look and feel of traditional ceramic tile and grout flooring systems. The present invention provides such a flooring system.

SUMMARY OF THE INVENTION

It is, therefore, an object of the present invention to provide a flooring panel including a decorative upper surface and a lower surface shaped and dimensioned for engaging a support surface on which the flooring panel is to be installed. The flooring panel further includes a plurality of edges extending between the decorative upper surface and the lower surface. The plurality of edges are shaped and dimensioned for selective coupling with adjacent flooring panels, wherein each of the plurality of edges includes an edge profile having at least a male coupling member or a female coupling member shaped and dimensioned for engaging mating male coupling members or female coupling members of an adjacent flooring panel. The flooring panel also includes at least one notched transition section. The at least one notched transition section extends between one of the plurality of edges of the flooring panel and the decorative upper surface of the flooring panel. When adjacent flooring panels are brought together by coupling respective male coupling members and female coupling members along respective edges of the adjacent flooring panels, the at least one notched transition section of the flooring panel defines a grout receiving recess into which a material may be poured for creation of the a grout line between the adjacent flooring panels.

It is also an object of the present invention to provide first and second flooring panels as described above. The system includes a grout receiving recess at the coupling line of the first flooring panel and the second flooring panel and a material applied within the grout receiving recess to form a grout line at the coupling point of the first flooring panel and the second flooring panel.

It is another object of the present invention to provide a method for installing flooring panels. The method is achieved by installing a first flooring panel as described above upon a support surface. A second flooring panel as described above is then installed upon the support surface in mating engagement with the first flooring panel. Material is then applied within the grout receiving recess to form a grout line at the coupling point of the first flooring panel and the second flooring panel.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for teaching one skilled in the art how to make and/or use the invention.

Figure 1:
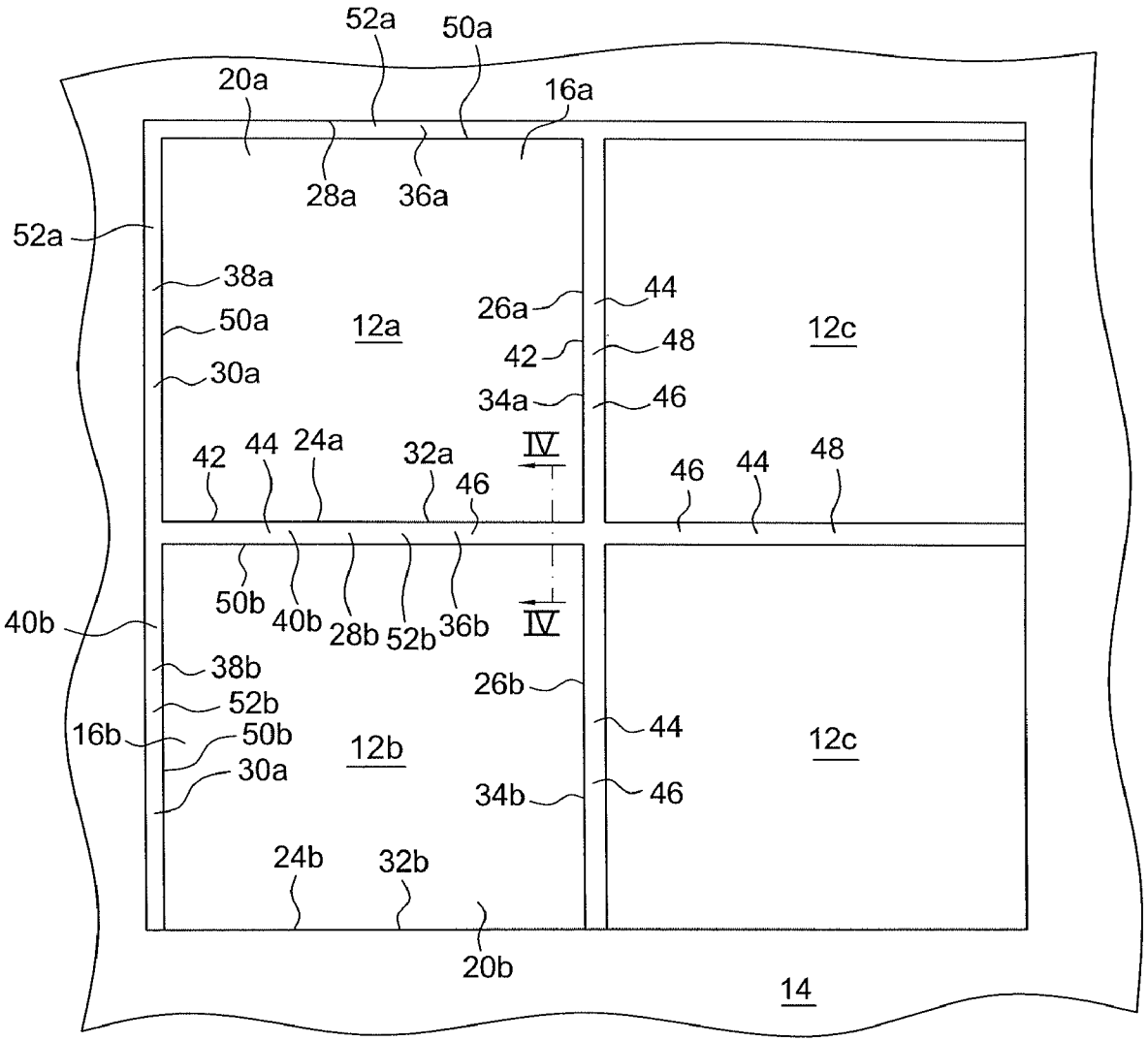
FIG. 1 is a top view of the present decorative laminate flooring system.

With reference to FIG. 1, a flooring system 10 is disclosed. The flooring system 10 includes a plurality of flooring panels 12*a*, 12*b* interconnected in a manner defining a predetermined flooring surface. Although the present disclosure describes the concepts underlying the present invention with reference to a first flooring panel 12*a* and a second flooring panel 12*b*, those skilled in the art will understand how the concepts of the present invention will be extended to a plurality of flooring panels covering a predetermined flooring surface. Those skilled in the art will further appreciate all the flooring panels are substantially identical.

As mentioned above, the present flooring system 10 includes at least a first flooring panel 12*a* and a second flooring panel 12*b* shaped and dimensioned for glueless coupling along a support surface 14. Although glueless coupling techniques are contemplated in accordance with a preferred embodiment of the present invention, the concepts of the present invention may be applied to coupling mechanisms utilizing glue or other coupling techniques without departing from the spirit of the present invention.

The first flooring panel 12*a* includes a decorative laminate 16*a* coupled to a top surface of a substantially rigid substrate 18*a*, wherein the first flooring panel 12*a* includes a decorative upper surface 20*a* composed of the decorative laminate 16*a* and a lower surface 22*a* shaped and dimensioned for engaging the support surface 14 on which the first flooring panel 12*a* is to be installed. In accordance with a preferred embodiment, the decorative laminate 16*a* is a conventional high pressure decorative laminate used in the flooring industry, although those skilled in the art will appreciate other laminates, for example, direct pressure laminates, may be used without departing from the spirit of the present invention.

As such, the decorative laminate 16*a* includes a plurality of layers of synthetic resin impregnated paper sheets consolidated or bonded together into a unitary structure under heat and pressure. In normal practice, the decorative laminate assembly, from the bottom up, includes a core of one or more sheets of Kraft paper impregnated with phenolic resin, above which lies a decorative sheet of alpha-cellulose paper impregnated with melamine resin and/or an overlay impregnated with melamine resin. The decorative laminate is consolidated by placing the resin impregnated core and decorative sheets between steel coated, steel, or stainless steel plates and subjecting the laminate stack to temperatures ranging from about 150° F. (65.6° C.) to about 500° F. (260° C.) and pressures ranging from about 800 to about 1600 psi for a time sufficient to consolidate the laminate and cure the resins (generally about 25 minutes to an hour). This causes the resin in the paper sheets to flow, cure, and consolidate the sheets into a composite or unitary laminated mass referred to in the art as a high pressure decorative laminate (HPDL). More than one laminate can be formed at one time by inserting a plurality of assembled sheets in a stack with each assembly being separated by a release sheet which allows the individual laminates to be separated after consolidation. Finally, the decorative laminates are further processed and ultimately secured to the substrate 18*a*.

In accordance with a preferred embodiment of the present invention, the substrate 18*a* is medium density fiberboard. However, those skilled in the art will appreciate, other materials, such as, but not limited to, high density fiber board, wood/plastic compositions, woods, plywood, hardboard, asbestos board, particleboard, ceramics, filled and unfilled plastics, closed-cell rigid foams, or the like, may be employed.

In accordance with a preferred embodiment, the first flooring panel 12*a* includes a plurality of edges extending between the upper surface 20*a* and the lower surface 22*a*, preferably, first, second, third and fourth edges 24*a*, 26*a*, 28*a*, 30*a* define a floor panel in the shape of a square. Those skilled in the art will certainly appreciate a variety of panel shapes may be employed without departing from the spirit of the present invention. The plurality of edges 24*a*, 26*a*, 28*a*, 30*a* are shaped and dimensioned for selective coupling with a second flooring panel 12*b* (or other flooring panels 12*c* substantially identical to the first and second flooring panels 12*a*, 12*b* described herein), wherein each edge of the first flooring panel 12*a* includes an edge profile having at least a male coupling member 32*a*, 34*a* or a female coupling member 36*a*, 36*b* shaped and dimensioned for engaging a mating male coupling member 32*b*, 34*b* or female coupling member 36*b*, 38*b* of the second flooring panel 12*b* (or other identical flooring panel 12*c*).

Figure 2:
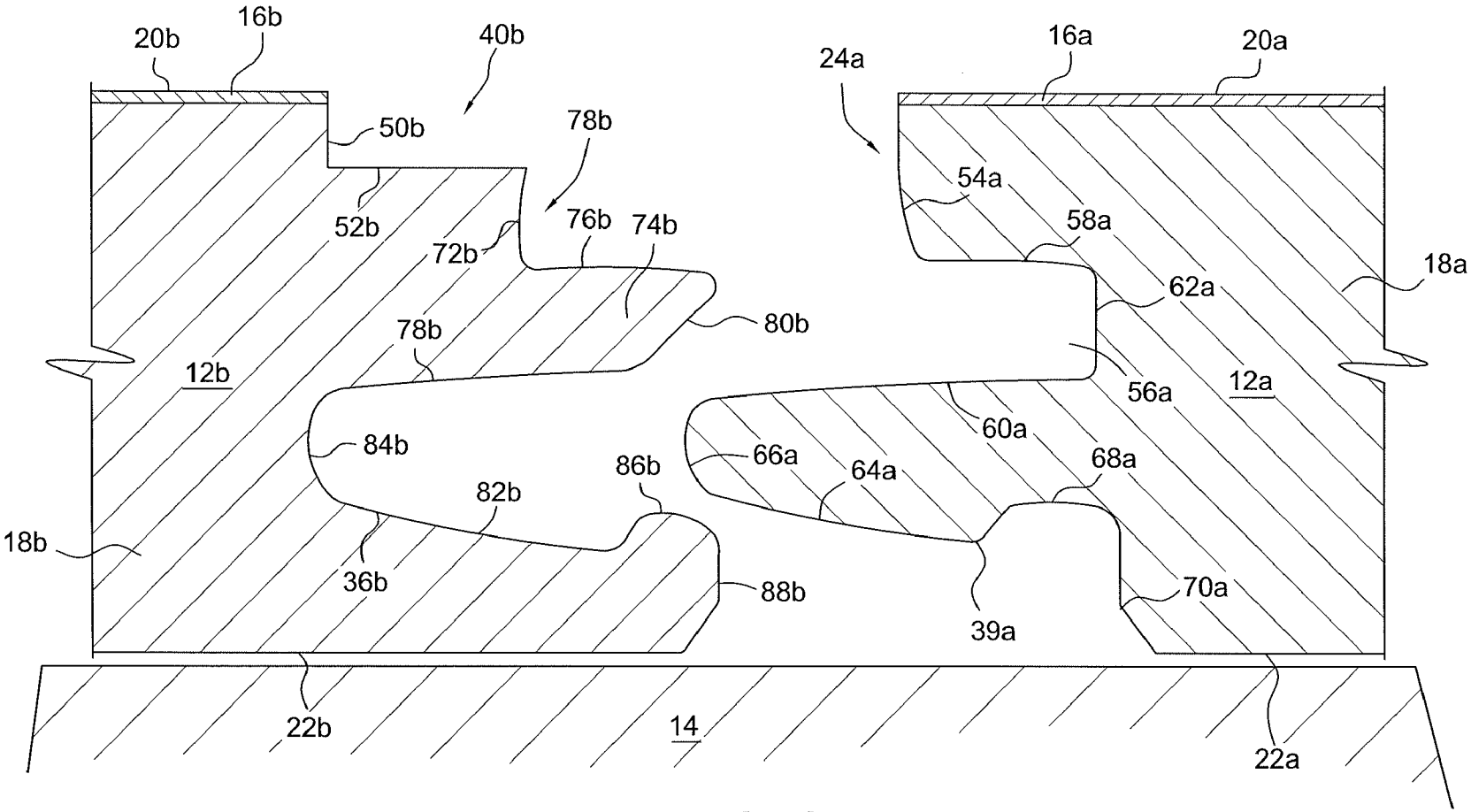
FIG. 2 is a cross-sectional view showing first and second flooring panels spaced from each other.
Figure 3:
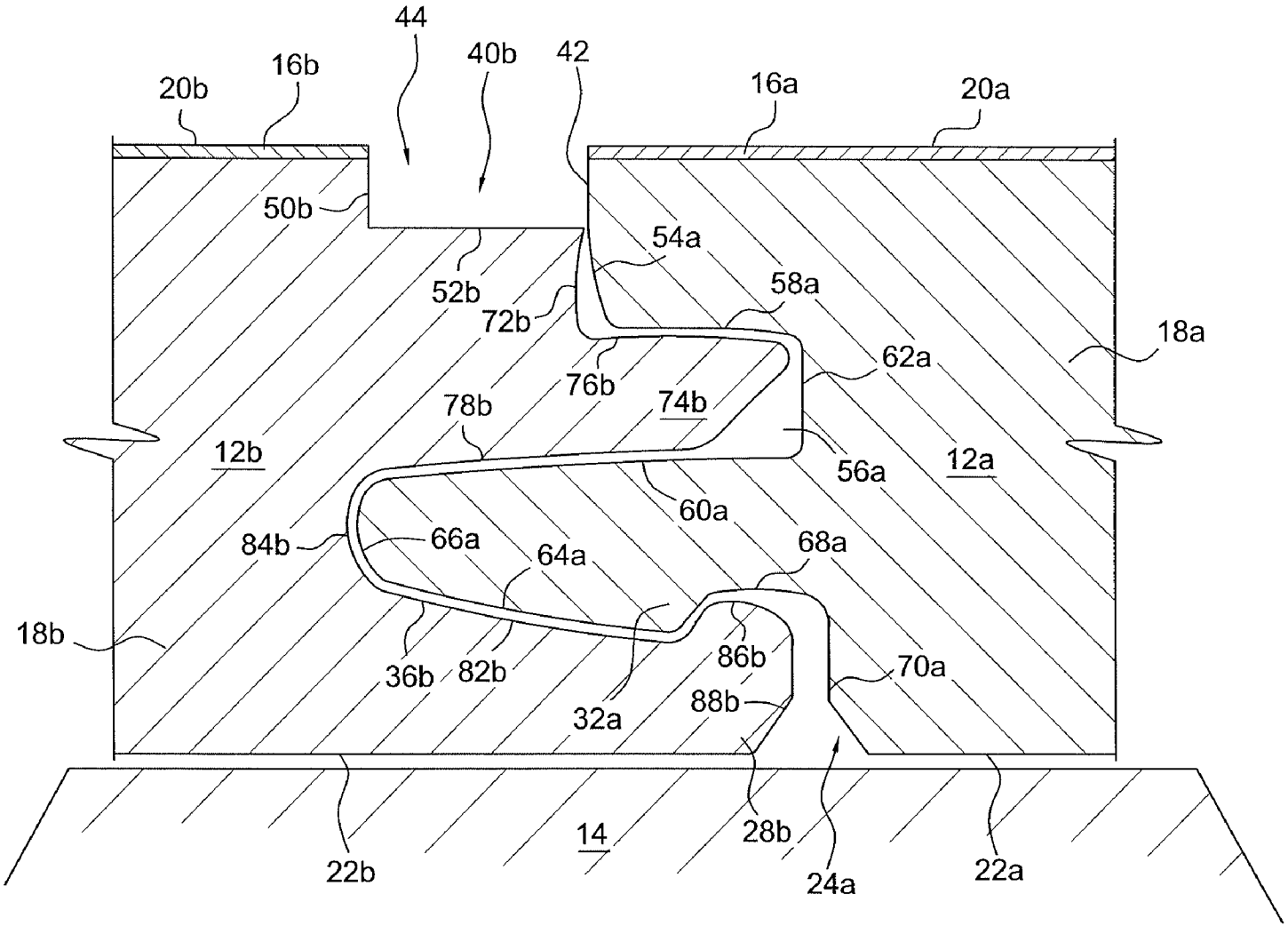
FIG. 3 is a cross-sectional view showing first and second flooring panels engaged and defining a grout receiving recess.
Figure 4:
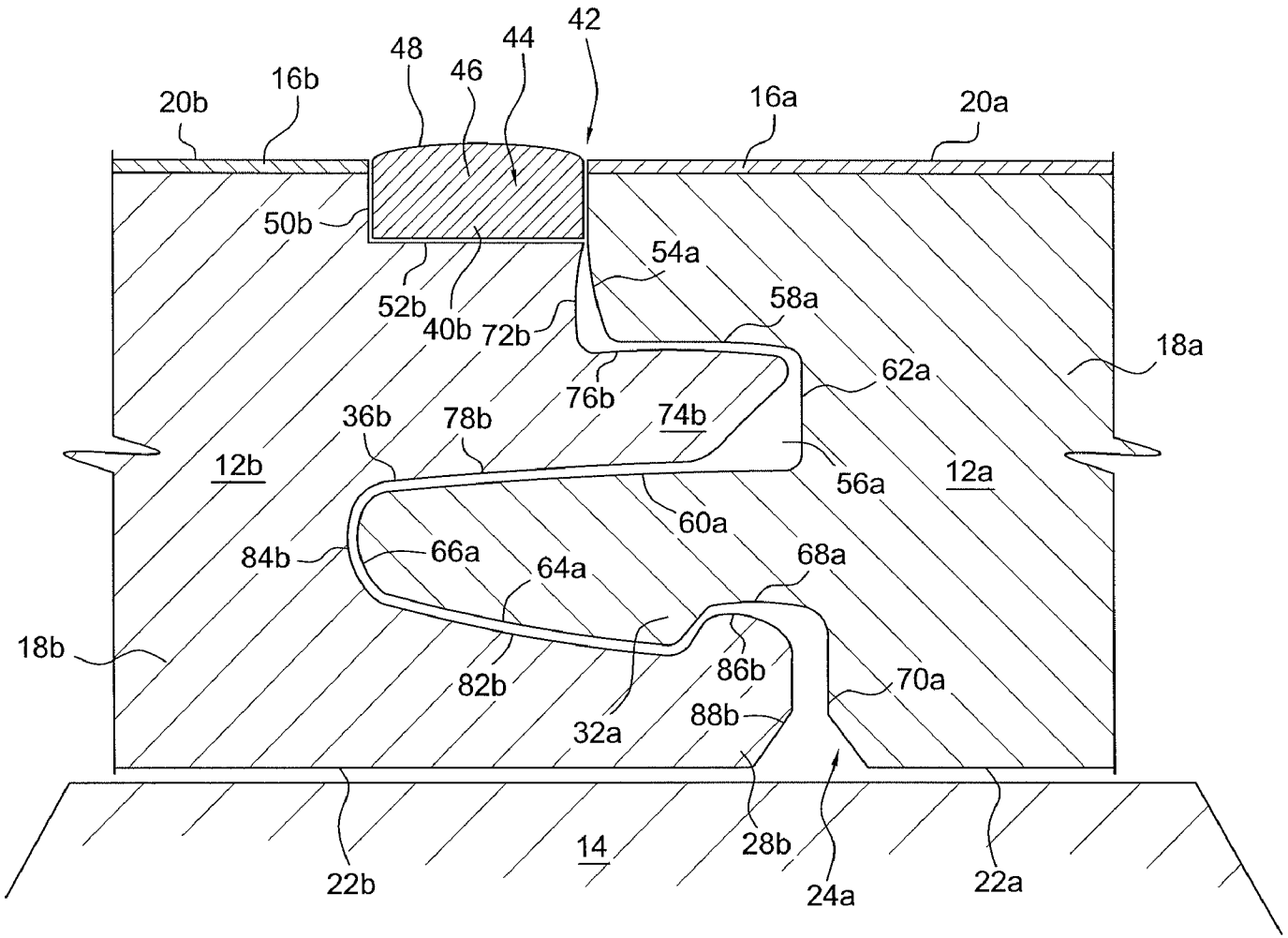
FIG. 4 is a cross-sectional view along the line IV-IV as shown in FIG. 1 and shows the creation of a grout line with the engaged first and second flooring panels.

In accordance with a preferred embodiment of the present invention, the first edge 24*a* is provided with a male coupling member 32*a* shaped and dimensioned to mate with a female coupling member 36*b*, 38*b* of the second (or another) flooring panel 12*b*, the second edge 26*a* is provided with a male coupling member 34*a* (identical to male coupling member 32*a* as shown in FIGS. 2, 3 and 4) shaped and dimensioned to mate with a female coupling member 36*b*, 38*b* (identical to female coupling member 36*b* as shown in FIGS. 2, 3 and 4) of the second (or another) flooring panel 12*b*, the third edge 28*b* is provided with a female coupling member 36*a* (identical to female coupling member 36*b* as shown in FIGS. 2, 3 and 4) shaped and dimensioned to mate with a male coupling member 32*b*, 34*b* (identical to male coupling member 32*a* as shown in FIGS. 2, 3 and 4) of the second (or another) flooring panel 12*b*, the fourth edge 30*a* is provided with a female coupling member 38*a* (identical to female coupling member 36*b* as shown in FIGS. 2, 3 and 4) shaped and dimensioned to mate with a male coupling member 32*b*, 34*b* (identical to male coupling member 32*a* as shown in FIGS. 2, 3 and 4) of the second (or another) flooring panel 12*b*.

Respective notched transition sections 40*a* extend between the third and fourth edges 28*a*, 30*a* of the first flooring panel 12*a* and the decorative upper surface 20*a* of the first flooring panel 12*a*. The notched transition sections 40*a* are identical to those shown with reference to the second flooring panel 12*b* in FIGS. 2, 3 and 4 (and described in detail below), and include a generally vertical first wall 50*a* that is oriented substantially perpendicular relative to the plane in which the decorative upper surface 20*a* of the first flooring panel 12*a* lies and a generally horizontal second wall 52*a* that is oriented substantially perpendicular relative to the plane in which the decorative upper surface 20*a* of the first flooring panel 12*a* lies. In accordance with a preferred embodiment, the vertical first wall 50*a* is approximately 0.9 mm to approximately 1.0 mm in depth and defines the depth of the grout receiving recess 44 discussed below in greater detail. The horizontal second wall 52*a* is approximately 4.3 mm in width and defines the width of the grout receiving recess 44 discussed below in greater detail.

As with the first flooring panel 12*a*, the second flooring panel 12*b* includes a decorative laminate 16*b* coupled to a top surface of a substantially rigid substrate 18*b*, wherein the second flooring panel 12*b* includes a decorative upper surface 20*b* composed of the decorative laminate 16*b* and a lower surface 22*b* shaped and dimensioned for engaging the support surface 14 on which the second flooring panel 12*b* is to be installed. In accordance with a preferred embodiment, and as discussed above with regard to the first flooring panel 12*a* the decorative laminate 16*b* is a conventional high pressure decorative laminate used in the flooring industry and described above with reference to the first flooring panel 12*a*.

In accordance with a preferred embodiment, the second flooring panel 12*b* includes a plurality of edges extending between the decorative upper surface 20*b* and the lower surface 22*b*, preferably, first, second, third and fourth edges 24*b*, 26*b*, 28*b*, 30*b* define a panel in the shape of a square. As with the first flooring panel 12*a*, a variety of flooring panel shapes may be employed without departing from the spirit of the present invention. The plurality of edges 24*b*, 26*b*, 28*b*, 30*b* are shaped and dimensioned for selective coupling with the first flooring panel 12*a* (or other flooring panels 12*c* substantially identical to the first and second flooring panels 12*a*, 12*b* described herein), wherein each edge of the second flooring panel 12*b* includes an edge profile having at least a male coupling member 32*b*, 34*b* or a female coupling member 36, 38*b* shaped and dimensioned for engaging a mating male coupling member 32*a*, 32*b* or female coupling member 36*a*, 36*b* of the first flooring panel 12*a* (or other identical flooring panel 12*c*).

In accordance with a preferred embodiment of the present invention, the first edge 24*b* is provided with a male coupling member 32*b* (identical to male coupling member 32*a* as shown in FIGS. 2, 3 and 4) shaped and dimensioned to mate with the female coupling member 36*a*, 38*a* (identical to female coupling member 36*b* as shown in FIGS. 2, 3 and 4) of the first (or another) flooring panel 12*a*, the second edge 26*b* is provided with a male coupling member 34*b* (identical to male coupling member 32*a* as shown in FIGS. 2, 3 and 4) shaped and dimensioned to mate with a female coupling member 36*a*, 38*a* (identical to female coupling member 36*b* as shown in FIGS. 2, 3 and 4) of the first (or another) flooring panel 12*a*, the third edge 28*b* is provided with a female coupling member 36*b* shaped and dimensioned to mate with a male coupling member 32*a*, 34*a* (identical to male coupling member 32*a* as shown in FIGS. 2, 3 and 4) of the first (or another) flooring panel 12*a*, the fourth edge 30*b* is provided with a female coupling member 38*b* (identical to female coupling member 36*b* as shown in FIGS. 2, 3 and 4) shaped and dimensioned to mate with a male coupling member 32*a*,

32*a* (identical to male coupling member 32*a* as shown in FIGS. 2, 3 and 4) of the first (or another) flooring panel 12*a*.

Respective notched transition sections 40*b* extend between the third and fourth edges 28*b*, 30*b* of the second flooring panel 12*b* and the decorative upper surface 20*b* of the second flooring panel 12*b*. The notched transition sections 40*b* include a generally vertical first wall 50*b* that is oriented substantially perpendicular relative to the plane in which the decorative upper surface 20*a* of the first flooring panel 12*a* lies and a generally horizontal second wall 52*b* that is oriented substantially perpendicular relative to the plane in which the decorative upper surface 20*a* of the first flooring panel 12*a* lies. In accordance with a preferred embodiment, the vertical first wall 50*b* is approximately 0.9 mm to approximately 1.0 mm in depth and defines the depth of the grout receiving recess 44 discussed below in greater detail. The horizontal second wall 52*b* is approximately 4.3 mm in width and defines the width of the grout receiving recess 44 discussed below in greater detail.

More particularly, and in accordance a preferred embodiment, the male edge profiles of the first and second edges 24*a*, 24*b*, 26*a*, 26*b* of the first and second flooring panels 12*a*, 12*b* include (as described with reference to the first edge 24*a* of the first flooring panel 12*a*) a generally vertically oriented first male profile wall 54*a* that extends downwardly from the decorative upper surface 20*a* until it reaches a generally horizontally oriented recess 56*a* defined by a generally horizontal recess wall 58*a*, a generally horizontal upper wall 60*a* of the male coupling member 32*a*, and a generally vertical connecting wall 62*a*. A male coupling member 32*a* extends outwardly below the horizontally oriented recess 56*a* and is defined by the generally horizontal upper wall 60*a* and a downwardly tapered lower wall 64*a* connected by a generally vertically oriented end wall 66*a*. The downwardly tapered lower wall 64*a* includes a recess 68*a* adjacent to the connected edge of the male coupling member 32*a*. A generally vertically oriented second male profile wall 70*a* extends from lower wall 64*a* of the male coupling member 32*a* to the lower surface 22*a*.

The female edge profiles of the third and fourth edges 28*a*, 28*b*, 30*a*, 30*b* of the first and second flooring panels 12*a*, 12*b* includes (as described with reference to the third edge 30*b* of the second flooring panel 12*b*) a generally vertically oriented first female profile wall 72*b* that extends downwardly from the notched transition section 40*b* until it reaches a generally horizontally oriented projection 74*b* defined by a generally horizontal projection wall 76*b*, a generally horizontal upper wall 78*b* of the female coupling member 36*b*, and an obliquely oriented connecting wall 80*b*. The horizontally oriented projection 74*b* is shaped and dimensioned to fit within the horizontally oriented recess 56*a* when adjacent panels are coupled in accordance with the present invention. A female coupling member 36*b* extends inwardly below the horizontally oriented projection 74*b* and is defined by the generally horizontal upper wall 78*b* and an upwardly tapered lower wall 82*b* connected by a generally horizontally oriented end wall 84*b*. The upwardly tapered lower wall 82*b* includes a projection 86*b* adjacent to its free end. The female coupling member 36*b* is shaped and dimensioned for coupling with the male coupling member 32*a*. The recess 68*a* and projection 86*b* along the lower walls 64*a*, 82*b* of the respective male and female coupling members 32*a*, 36*b* are shaped and dimensioned for selective coupling to hold adjacent flooring panels together. A generally vertically oriented second female profile wall 88*b* extends from lower wall of the female coupling member 36*b* to the lower surface 22*b*.

Relative orientations of the various components of the flooring components are described above through the use of terms such as vertical and horizontal. Those skilled in the art will appreciate these relative terms are used to describe the flooring panels in the usual placement on a horizontal support surface, and are not intended to limit the scope of the present disclosure. While specific profiles are disclosed in accordance with a preferred embodiment of the present invention, those skilled in the art will appreciate the present invention is not limited to the specific edge profiles disclosed above and various edge profiles may be used within the spirit of the present invention.

When the first flooring panel 12*a* and the second flooring panel 12*b* (or other identical flooring panels) are brought together along the coupling line 42 by coupling respective male coupling members 32*a*, 32*b*, 34*a*, 34*b* and female coupling members 36*a*, 36*b*, 38*a*, 38*b* of the respective edges of the first flooring panel 12*a* and the second flooring panel 12*b*, the respective notched transition sections 40*a*, 40*b* create a grout receiving recess 44 defined by the vertical first wall 50*a*, 50*b* of the notched transition section 40*a*, 40*b*, the horizontal second wall 52*a*, 52*b* of the notched transition section 40*a*, 40*b* and the vertically oriented first male profile wall 54*a* of the adjacent flooring panel. A grout material 46 may then be applied within the grout receiving recess 44 to form a grout line 48 at the coupling line 42 of the first flooring panel 12*a* and the second flooring panel 12*b*. Although grout material is used in accordance with a preferred embodiment, it is contemplated other materials, for example, paint, adhesive, plastic, rubber, epoxy, etc., may be used within the grout receiving recess.

In practice, the first flooring panel 12*a* is installed upon a support surface 14. The second flooring panel 12*b* is then installed upon the support surface 14 in mating engagement with the first flooring panel 12*a*. In accordance with a preferred embodiment, installation of the second flooring panel 12*b* in mating engagement with the first flooring panel 12*a* includes positioning the second flooring panel 12*b* adjacent the first flooring panel 12*a* and upon the support surface 14. Thereafter, an edge (for example, a third edge 28*b*) of the second flooring panel 12*b* is brought into mating engagement with an edge (for example, a first edge 24*a*) of the first flooring panel 12*a* along a coupling line 42. Mating of the first flooring panel 12*a* with the second flooring panel 12*b* creates the grout receiving recess 44 at the coupling line 42 of the first flooring panel 12*a* and the second flooring panel 12*b*.

Thereafter, a grout material 46 is applied within the grout receiving recess 44 to form a grout line 48 at the coupling line 42 of the first flooring panel 12*a* and the second flooring panel 12*b*.

As those skilled in the art will appreciate, the manner in which the first and second flooring panels are matingly engaged will depend upon the specific engagement profile adopted by the flooring manufacturer. Some edge profiles require that the flooring panels be brought into engagement with an initial angular offset, while other edge profiles allow the flooring panels to be mated while the sit in the same plane, for example, along the plane defined by the support surface upon which they sit.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A flooring panel, comprising:

a decorative upper surface and a lower surface shaped and dimensioned for engaging a support surface on which the flooring panel is to be installed;

the flooring panel further includes a plurality of edges extending between the decorative upper surface and the lower surface, the plurality of edges are shaped and dimensioned for selective coupling with adjacent flooring panels, wherein each of the plurality of edges includes an edge profile having at least a male coupling member or a female coupling member shaped and dimensioned for engaging mating male coupling members or female coupling members of an adjacent flooring panel;

at least one notched transition section, the at least one notched transition section extending between a first edge of the plurality of edges of the flooring panel and the decorative upper surface of the flooring panel, the at least one notched transition section includes a vertical first wall and a horizontal second wall, and the first edge includes a vertically oriented wall directly depending from the horizontal second wall and a coupling member positioned between the horizontal second wall and the lower surface of the flooring panel;

a second edge includes a vertically oriented first wall that extends downwardly from the decorative upper surface until it reaches a horizontal wall, and wherein a coupling member is positioned between the horizontal wall and the lower surface of the flooring panel;

wherein when adjacent flooring panels are brought together by coupling respective male coupling members and female coupling members along respective edges of the adjacent flooring panels a grout receiving recess is formed into which a grout material may be poured for creation of the a grout line between the adjacent flooring panels, the grout receiving recess being defined by the vertical first wall of the notched transition section, the horizontal second wall of the notched transition section and the vertically oriented first wall of the adjacent flooring panel.

2. The flooring panel according to claim 1, wherein the decorative upper surface is a decorative laminate that is secured to a substantially rigid substrate.

3. The flooring panel according to claim 1, a plurality of notched transition sections extend between respective edges of the flooring panel and the decorative upper surface of the flooring panel.

4. A flooring system comprising:

a first flooring panel including a decorative upper surface and a lower surface shaped and dimensioned for engaging a support surface on which the first flooring panel is to be installed; the first flooring panel further includes a plurality of edges extending between the decorative upper surface and the lower surface, the plurality of edges are shaped and dimensioned for selective coupling with a second flooring panel, wherein each of the plurality of edges of the first flooring panel includes an edge profile having at least a male coupling member or a female coupling member shaped and dimensioned for engaging a mating male coupling member or female coupling member of the second flooring panel; and at least one notched transition section, the at least one notched transition section extending between a first edge of the plurality of edges of the first flooring panel and the decorative upper surface of the first flooring panel, the at least one notched transition section includes a vertical first wall and a horizontal second wall; a second edge includes a substantially vertically oriented first wall that extends downwardly from the decorative upper surface until it reaches a horizontal wall;

the second flooring panel includes a decorative upper surface and a lower surface shaped and dimensioned for engaging the support surface on which the second flooring panel is to be installed; the second flooring panel further includes a plurality of edges extending between the decorative upper surface and the lower surface, the plurality of edges are shaped and dimensioned for selective coupling with the first flooring panel, wherein each of the plurality of edges of the second flooring panel includes an edge profile having at least a male coupling member or a female coupling member shaped and dimensioned for engaging a mating male coupling member or female coupling member of the first flooring panel; and at least one notched transition section, the at least one notched transition section extending between a first edge of the plurality of edges of the second flooring panel and the decorative upper surface of the second flooring panel; wherein the first flooring panel and the second flooring panel are brought together along a coupling line by coupling respective male coupling members and female coupling members of respective edges of the first flooring panel and the second flooring panel, the at least one notched transition section includes a vertical first wall and a horizontal second wall; a second edge includes a vertically oriented first wall that extends downwardly from the decorative upper surface until it reaches a horizontal wall;

a grout receiving recess at the coupling line of the first flooring panel and the second flooring panel, the grout receiving recess consisting essentially of the vertical first wall of the notched transition section of the first flooring panel, the horizontal second wall of the notched transition section of the first flooring panel and the vertically oriented first wall of the a second flooring panel; and a grout material applied within the grout receiving recess to form a grout line at the coupling point of the first flooring panel and the second flooring panel.

5. The flooring system according to claim 4, wherein the decorative upper surface of the first flooring panel is a decorative laminate that is secured to a substantially rigid substrate and the decorative upper surface of the second flooring panel is a decorative laminate that is secured to a substantially rigid substrate.

6. The flooring system according to claim 4, wherein the first flooring panel includes a plurality of notched transition sections extending between respective edges of the first flooring panel and the decorative upper surface of the first flooring panel and the second flooring panel includes a plurality of notched transition sections extending between respective edges of the second flooring panel and the decorative upper surface of the second flooring panel.

7. A method for installing flooring panels, comprising:

installing a first flooring panel upon a support surface, the first flooring panel including a decorative upper surface and a lower surface shaped and dimensioned for engaging the support surface on which the first flooring panel is to be installed; the first flooring panel further includes a plurality of edges extending between the decorative upper surface and the lower surface, the plurality of edges are shaped and dimensioned for selective coupling with a second flooring panel, wherein each of the plurality of edges of the first flooring panel includes an edge profile having at least a male coupling member or a female coupling member shaped and dimensioned for engaging a mating male coupling member or female coupling member of the second flooring panel; the first flooring panel also includes at least one notched transition section, the at least one notched transition section extending between a first edge of the plurality of edges of the first flooring panel and the decorative upper surface of the first flooring panel, the at least one notched transition section includes a vertical first wall and a horizontal second wall, and the first edge includes a vertically oriented wall directly depending from the horizontal second wall and a coupling member positioned between the horizontal second wall and the lower surface of the flooring panel;

and a second edge includes a vertically oriented first wall that extends downwardly from the decorative upper surface until it reaches a horizontal wall, and wherein a coupling member is positioned between the horizontal wall and the lower surface of the flooring panel;

installing the second flooring panel upon the support surface in mating engagement with the first flooring panel, the second flooring panel includes a decorative upper surface and a lower surface shaped and dimensioned for engaging the support surface on which the second flooring panel is to be installed; the second flooring panel further includes a plurality of edges extending between the decorative upper surface and the lower surface, the plurality of edges are shaped and dimensioned for selective coupling with the first flooring panel, wherein each of the plurality of edges of the second flooring panel includes an edge profile having at least a male coupling member or a female coupling member shaped and dimensioned for engaging a mating male coupling member or female coupling member of the first flooring panel; the second flooring panel includes at least one notched transition section, the at least one notched transition section extending between a first edge of the plurality of edges of the first flooring panel and the decorative upper surface of the second flooring panel, the at least one notched transition section includes a vertical first wall and a horizontal second wall, and the first edge including a vertically oriented wall directly depending from the horizontal second wall and a coupling member positioned between the horizontal second wall and the lower surface of the flooring panel;

and a second edge includes a vertically oriented first wall that extends downwardly from the decorative upper surface until it reaches a horizontal wall, and wherein a coupling member is positioned between the horizontal wall and the lower surface of the flooring panel;

wherein the first flooring panel and the second flooring panel are brought together along a coupling line by coupling respective male coupling members and female coupling members of respective edges of the first flooring panel and the second flooring panel; the step of installing the second panel includes positioning the second flooring panel adjacent the first flooring panel and upon the support surface, and bringing one of the plurality of edges of the second flooring panel into mating engagement with one of the plurality of edges of the first flooring panel along the coupling line, wherein mating engagement of the first flooring panel with the second flooring panel engagement along the coupling line creates a grout receiving recess at the coupling line of the first flooring panel and the second flooring panel, the grout receiving recess being defined by the vertical first wall of the notched transition section of the first flooring panel, the horizontal second wall of the notched transition section of the first flooring panel and the vertically oriented first wall of the second flooring panel; and applying grout material within the grout receiving recess to form a grout line at the coupling point of the first flooring panel and the second flooring panel.

8. The method according to claim 7, wherein the decorative upper surface of the first flooring panel is a decorative laminate that is secured to a substantially rigid substrate and the decorative upper surface of the second flooring panel is a decorative laminate that is secured to a substantially rigid substrate end.

9. The method according to claim 7, wherein the first flooring panel includes a plurality of notched transition sections extending between respective edges of the first flooring panel and the decorative upper surface of the first flooring panel and the second flooring panel includes a plurality of notched transition sections extending between respective edges of the second flooring panel and the decorative upper surface of the second flooring panel.

10. A flooring system comprising:

a first flooring panel including a decorative laminate having an upper surface and an edge portion, and a lower surface shaped and dimensioned for engaging a support surface on which the first flooring panel is to be installed; the first flooring panel further includes a plurality of edges extending between the decorative laminate and the lower surface, the plurality of edges are shaped and dimensioned for selective coupling with a second flooring panel, wherein each of the plurality of edges of the first flooring panel includes an edge profile having at least a male coupling member or a female coupling member shaped and dimensioned for engaging a mating male coupling member or female coupling member of the second flooring panel; and at least one notched transition section, the at least one notched transition section extending between a first edge of the plurality of edges of the first flooring panel and the upper surface of the decorative laminate of the first flooring panel and the at least one notched transition section includes a vertical first wall, including the edge portion of the decorative laminate, and a horizontal second wall; a second edge includes a substantially vertically oriented first wall, including the edge portion of the decorative laminate, that extends downwardly from the upper surface of the decorative laminate;

the second flooring panel includes a decorative laminate having an upper surface and an edge portion, and a lower surface shaped and dimensioned for engaging the support surface on which the second flooring panel is to be installed; the second flooring panel further includes a plurality of edges extending between the decorative laminate and the lower surface, the plurality of edges are shaped and dimensioned for selective coupling with the first flooring panel, wherein each of the plurality of edges of the second flooring panel includes an edge profile having at least a male coupling member or a female coupling member shaped and dimensioned for engaging a mating male coupling member or female coupling member of the first flooring panel; and at least one notched transition section, the at least one notched transition section extending between a first edge of the plurality of edges of the second flooring panel and the upper surface of the decorative laminate of the second flooring panel; wherein the first flooring panel and the second flooring panel are brought together along a coupling line by coupling respective male coupling members and female coupling members of respective edges of the first flooring panel and the second flooring panel, the at least one notched transition section extending between the first edge of the plurality of edges of the second flooring panel and the upper surface of the decorative laminate of the second flooring panel and the at least one notched transition section includes a vertical first wall, including the edge portion of the decorative laminate, and a horizontal second wall; a second edge includes a substantially vertically oriented first wall, including the edge of the decorative laminate, that extends downwardly from the upper surface of the decorative laminate;

a grout receiving recess at the coupling line of the first flooring panel and the second flooring panel, the grout receiving recess including the vertical first wall of the notched transition section of the first flooring panel, the horizontal second wall of the notched transition section of the first flooring panel and the vertically oriented first wall of the a second flooring panel; and a grout material applied within the grout receiving recess to form a grout line at the coupling point of the first flooring panel and the second flooring panel.

* * * * *